US005205095A

United States Patent [19]

Kessler

[11] Patent Number: 5,205,095

[45] Date of Patent: Apr. 27, 1993

[54] DROP-IN GLAZING

[76] Inventor: Gerald Kessler, P.O. Box 389, Youngstown, Ohio 44501

[21] Appl. No.: 705,437

[22] Filed: May 24, 1991

[51] Int. Cl.[5] ..... E06B 3/62; E06B 7/16

[52] U.S. Cl. ..... 52/208; 52/400; 296/93; 296/201

[58] Field of Search ..... 52/208, 397, 398, 400; 296/93, 201

[56] References Cited

U.S. PATENT DOCUMENTS

| | | | |
|---|---|---|---|
| 741,197 | 10/1903 | Wadey | 52/397 |
| 2,641,031 | 6/1953 | Ehret | 52/398 |
| 2,848,761 | 8/1958 | Hahn | 52/208 |
| 3,344,573 | 10/1967 | Martin et al. . | |
| 3,705,470 | 12/1972 | Kent | 52/208 |
| 3,807,107 | 4/1974 | Davis . | |
| 3,881,290 | 5/1975 | Bouchey . | |
| 3,981,118 | 9/1976 | Johnson et al. | 52/397 |
| 4,006,569 | 2/1977 | Kain . | |
| 4,074,490 | 2/1978 | Nagase | 52/397 |
| 4,151,696 | 5/1979 | Knights et al. | 52/397 |
| 4,562,676 | 1/1986 | Kruschwitz | 52/208 |
| 4,599,833 | 7/1986 | Bullock | 52/397 |
| 4,712,341 | 12/1987 | Harris, Jr. et al. | 52/208 |
| 4,775,570 | 10/1988 | Ohlenforst et al. . | |
| 4,825,609 | 5/1989 | Rundo . | |
| 4,905,432 | 3/1990 | Romie | 52/208 |

*Primary Examiner*—Richard E. Chilcot, Jr.
*Assistant Examiner*—Joanne C. Downs
*Attorney, Agent, or Firm*—Browdy and Neimark

[57] ABSTRACT

A combination of an adhesive-supporting clip and an aluminum or PVC sash with a drop-in light opening for a glass pane. The adhesive-supporting clip serves as the connection between the glass pane mounted in the sash and the sash itself. This is achieved by mounting the clip to the glazing leg of the sash through a mechanical connection on the clip and then dropping the perimeter of the glass pane onto an adhesive applied to an exposed surface of the clip. This permits a glazer to rapidly remove and replace a broken glass pane by simply disengaging the clip and reinstalling either the cleaned old clip or a new glass pane or mounting a new pane directly on the glazing leg.

5 Claims, 1 Drawing Sheet

DROP-IN GLAZING

FIELD OF THE INVENTION

The present invention relates to improvements in glazing of fabricated window sash and the like, particularly those of the type extruded from sections of aluminum or vinyl.

BACKGROUND OF THE INVENTION

There are in general two basic systems of glazing aluminum or vinyl window sash.

The first system involves the use of a generally U-shaped flexible channel which is either separately mounted on the edges of the glass pane or is integral with the sash. In either situation, the glass pane is secured to the channel by a friction fit, caulking or a combination of both. The majority of sash constructions use a separate flexible U-channel or a dual durometer sash having an integral U-shaped channel with flexible ribs projecting inwardly or some sort of retainer bead or the like.

The second system of glazing such sash involves "drop-in" glass where a glass pane is inserted into the open "light" so that all its bare edges abut a flange or glazing leg which extends inwardly from the sash or mainframe. This is the same system used for many years in the glazing of wooden sash. The chief problem resulting from use of the "drop-in" method of glazing aluminum and vinyl sash, where caulking or glue is used as the main retention agent for the glass, is the difficulty in reglazing if the glass is broken. One reason is the problem in removing some types of glazing retainer beads.

Another almost universal problem results from dropping the glass directly onto an adhesive on the flange or glazing leg of an aluminum or vinyl sash. Whether the adhesive used in securing the glass pane to the sash is the gunnable type or a tape type both adhesives are intended to adhere to the aluminum or vinyl and to the glass. This of course, makes removal of broken glass and its replacement very difficult as reglazing requires not only the disposal of the broken glass but removal of the original adhesive remaining on the glazing leg before applying the new adhesive and glass.

U.S. Pat. No. 3,344,573 addresses this problem to some extent by providing a glazing strip that is first adhesively fastened to a glass pane. The pane is thereafter dropped into the open light without securing the glazing strip to the sash. Thereafter, the pane with glazing strip attached is secured to the sash by a glazing bead applied to the outside surface of the glass and the sash. A major problem of this system is that it still requires the use of a glazing bead which, when the glass breaks, creates problems in removal of the broken glass. In addition, the glazing bead involves an extra element which drives up the overall cost of the sash. Further, the device of U.S. Pat. No. 3,344,573 cannot be reused if the pane to which it is attached is broken.

SUMMARY OF THE INVENTION

An object of the present invention is to achieve a substantial improvement in the "drop-in" system of glazing aluminum or vinyl window sash by overcoming deficiencies of the prior art, including those noted above.

A further object of this invention is to provide a means for simplifying the removal of a broken pane from an aluminum or vinyl sash and eliminating the need to remove the original adhesive directly from the glazing leg of such sash.

An additional object of this invention is to facilitate the reglazing of an aluminum or vinyl sash by speeding the removal of the broken pane and original adhesive.

These objectives of the invention are achieved by providing an adhesive clip which is functionally retained by a flange or glazing leg of the aluminum or vinyl sash itself. The adhesive holding the glass pane in place on the clip and within the sash is applied to a surface of the adhesive clip and the glass pane is dropped into the sash and adheres to this adhesive. If the glass is broken, the adhesive clip and remaining glass adhering to the clip can be rapidly removed and discarded by simply disengaging the clip from the sash.

The glazer may then install a new clip if so desired. However, if a new clip is not available, the remaining glass adhering to the old clip can be removed inside a warm building using appropriate solvents thereby avoiding any harm to the sash. Alternatively, if the glazer does not wish to remove the remaining adhering glass from the clip or install a new clip, he can install the new pane of glass directly onto the flange or glazing leg using adhesive applied directly to the flange or leg.

The simple alternatives made available to the glazer by the present invention reduces the chance of the necessity of a complete sash replacement due to the inability to remove broken glass from the sash. Such breakage is presently common and will become a more frequent occurrence when previously installed aluminum and vinyl sash weaken with age.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
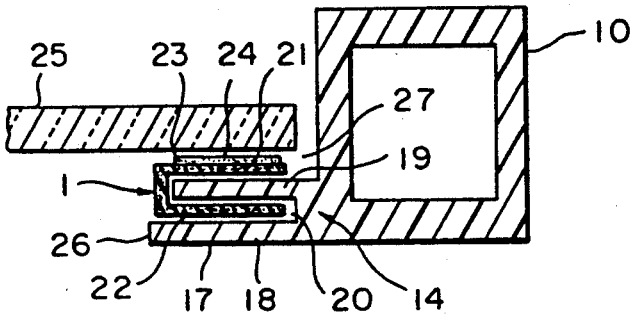
FIG. 1 is a partial transverse sectional view through a glazed window sash showing a first embodiment of the invention.
Figure 2:
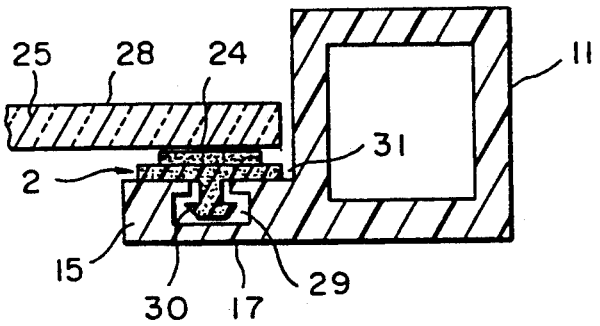
FIG. 2 is a partial transverse sectional view through a glazed window sash showing a second embodiment of the invention.
Figure 3:
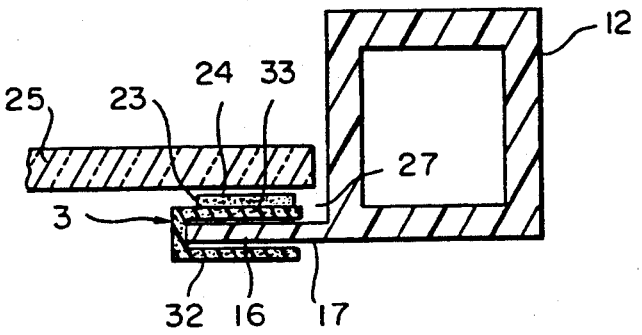
FIG. 3 is a partial transverse sectional view through a glazed window sash showing a third embodiment of the invention.

Referring first to FIGS. 1-3, different embodiments of the adhesive clip 1, 2, 3 of the invention are shown applied to three different window sash 10, 11 and 12, each fabricated from extruded aluminum or rigid PVC. In each sash 10, 11, 12 the head, jamb and sill sections are of like cross-section and can be mitered and welded or otherwise secured together at their adjoining corners as is conventional to form a unitary endless frame defining a light opening (not shown) bordered inside the opening by a planar flange or glazing leg 14, 15, 16. The light opening is not limited to rectangular openings so that the invention can be applied to an oval opening, for example. Flange or glazing leg 14, 15, 16 is shown with a surface 17 which is desirably in the same plane as surface of sash 10, 11, 12. Surface 17 would ordinarily face into the interior of the building in which the sash is installed.

As shown in the embodiment of FIG. 1, planar glazing leg 14 consists of parallel flanges 18 and 19 with a slot 20 interposed therebetween. The adhesive clip 1 of this embodiment is shown to be U-shaped in cross-section and when installed in a rectangular light opening can be mitered at their corners so that the clip will extend along its length continuously around the opening. As shown, U-shaped adhesive clip 1 has two legs 21 and 22.

Leg 21 has an outer face 23 which faces to the outside of the building in which sash 10 is or is to be installed. This outer face 23 serves as the glass pane support surface on which adhesive 24 is deposited for later engagement to the glass pane 25. Adhesive 24 is deposited on the outer face 23 either before or after installation of clip 1. Further, adhesive 24 can be applied either as a bead by a caulking type gun or as a prefabricated strip. When clip 1 is installed around the light opening as described and an adhesive 24 affixed to outer face 23 of clip 1, the glass pane 25 is ready for installation.

The adhesive-supporting clip 1 can be extruded from rigid PVC or other suitable material to hug the flange 19 to assist in securing clip 1 to sash 10. Leg 22 of clip 1 is made to friction fit into the slot 20 between flange 18 and flange 19 of glazing leg 14. Flange 18 of glazing leg 14 serves not only to secure the leg 22 of clip 1 to the sash 10 but also to conceal the leg 22 from view from inside the building in which the sash is installed.

While flange 18 is shown to be slightly longer than flange 19 in order to conceal clip 1 from view from the interior of the building, the relative lengths of these flanges can be varied for appearance purposes. Indeed, the edge 26 of the flange 18 can be beveled or otherwise detailed to provide different interior finishes.

FIG. 1 also shows leg 21 of clip 1 slightly smaller in width than flange 19 thereby creating gap 27 which permits the glazer to insert a tool to facilitate removal of clip 1 when reglazing.

FIG. 2 illustrates as another embodiment of the invention an adhesive clip 2 cooperating with a sash or mainframe 11.

Adhesive-supporting clip 2 is intended to serve the same purpose as clip 1 described above and is provided with an outer surface 28 to receive an adhesive 24 in the same fashion as described above in connection with clip 1. Further, clip 2 is also extruded from polyvinyl chloride or other suitable material. However, adhesive clip 2 is secured in a groove 29 of flange 15 of sash 11 by a T-shaped projection 30 which extends the full length of extruded clip 2 which surrounds the entire light opening in a manner similar to clip 1. The clip 2 is firmly secured to the sash by either pressure fitting or sliding T-shaped projection 30 into groove 29 which also extends entirely around the light opening in flange 15.

As shown in FIG. 2, clip 2 is made slightly smaller in width than flange 15 creating gap 31 when clip 2 is secured to flange 15. Gap 31 serves the same purpose as gap 27 discussed above.

As with clip 1, clip 2 is not visible from the interior of the building on which sash 11 is installed.

FIG. 3 illustrates as a third embodiment of the invention an adhesive-supporting clip 3 cooperating with a sash or mainframe 12. Adhesive clip 3 is similar to clip 1 in all respects with the exception that legs 32 and 33 are designed to friction fit over a single glazing leg 16 of sash 12. In this embodiment, leg 32 of clip 3 as well as its end is visible from the interior of the building on which sash 12 is installed unless otherwise covered by interior finishing. Glass pane 25 is secured to adhesive 24 on outer face 23 in the same manner as described in FIG. 1 discussed above.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A combination of an adhesive-supporting clip and a unitary sash having a light opening adapted to receive a glass pane, said combination comprising a continuous sash forming a light opening, said sash having a glazing leg extending inwardly toward said light opening;

a lip formed of rigid material and having mechanical means for detachably securing said clip directly to said glazing leg;

engagement means on said clip for directly receiving, supporting and substantially solely adhesively engaging a glass pane, said engagement means comprising an adhesive-coated surface of said clip extending substantially parallel to said glazing leg and being unobstructed so that the glass pane can be dropped directly onto said adhesive coated surface without deformation of said clip;

said adhesive being sufficiently strong so that said adhesive will hold the pane of glass on said clip by itself whereby the glass pane is secured to said sash by directly adhesively engaging the perimeter oft he glass pane to the adhesive on said surface of said clip, and whereby the residual of a broken glass pane can be removed by detaching said clip from said sash.

2. The combination as claimed in claim 1, wherein:

said mechanical means on said clip for detachably securing said adhesive-supporting clip to said glazing leg comprises interfitting shapes wherein said clip has two parallel legs friction fitted over said glazing leg.

3. The combination as claimed in claim 1, wherein:

a gap is provided between said clip and said sash to permit easy removal of said clip when the glass pane has been broken.

4. A combination of an adhesive-supporting clip and a unitary sash having a light opening adapted to receive a glass pane, said combination comprising:

a continuous sash forming a light opening, said sash having a glazing leg extending inwardly;

an adhesive-supporting clip having an adhesive receiving surface to engage the glass pane;

mechanical means on said adhesive-supporting clip for detachably securing said adhesive-supporting clip directly to said glazing leg;

said adhesive-supporting clip being directly engaged to said glazing leg;

said adhesive receiving surface of said adhesive-supporting clip having an adhesive thereon;

wherein the glass pane is secured to said sash by attaching the perimeter of the glass pane to the adhesive on said adhesive-receiving surface and the residual of a broken glass pane can be removed by detaching said adhesive-supporting clip from said sash;

said mechanical means on said adhesive-supporting clip for detachably securing said adhesive-supporting clip to said glazing leg comprising a T-shaped projection on a surface opposite to said adhesive receiving surface; and a substantially corresponding groove on said glazing leg detachably securing said T-shaped projection.

5. A combination of an adhesive-supporting clip and a unitary sash having a light opening adapted to receive a glass pane, said combination comprising:

a continuous sash forming a light opening, said sash having a glazing leg extending inwardly;

an adhesive-supporting clip having an adhesive receiving surface to engage the glass pane;

mechanical means on said adhesive-supporting clip for detachably securing said adhesive-supporting clip directly to said glazing leg;

said adhesive-supporting clip being directly engaged to said glazing leg;

said adhesive receiving surface of said adhesive-supporting clip having an adhesive thereon;

wherein the glass pane is secured to said sash by attaching the perimeter of the glass pane to the adhesive on said adhesive-receiving surface and the residual of a broken glass pane can be removed by detaching said adhesive-supporting clip from said sash;

said mechanical means on said adhesive-supporting clip for detachably securing said adhesive-supporting clip to said glazing leg comprising interfitting shapes of said clip and said glazing leg wherein said clip has two parallel legs and said glazing leg has a slot, one of said two parallel legs being friction fitted into said slot.

* * * * *